US011217221B2

(12) United States Patent
Valeri et al.

(10) Patent No.: US 11,217,221 B2
(45) Date of Patent: Jan. 4, 2022

(54) AUTOMOTIVE NOISE MITIGATION

(71) Applicant: GM GLOBAL TECHNOLOGY OPERATIONS LLC, Detroit, MI (US)

(72) Inventors: Frank C. Valeri, Novi, MI (US); Timothy J. Roggenkamp, Brighton, MI (US); Mark A. Gehringer, Milford, MI (US); Dennis J. Kinchen, Brighton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/592,468

(22) Filed: Oct. 3, 2019

(65) Prior Publication Data

US 2021/0104215 A1 Apr. 8, 2021

(51) Int. Cl.
*G10K 11/178* (2006.01)
*G10L 21/0232* (2013.01)

(52) U.S. Cl.
CPC ..... *G10K 11/178* (2013.01); *G10L 21/0232* (2013.01); *G10K 2210/1282* (2013.01)

(58) Field of Classification Search
CPC ..... G10K 11/178; G10K 2210/1282; G10K 11/17821; G10K 11/17833; G10K 11/17883; G10K 2210/30231; G10K 2210/3025; G10K 2210/3033; G10L 21/0232
USPC ..... 381/71.11, 71.14, 71.4; 123/345
See application file for complete search history.

(56) References Cited

U.S. PATENT DOCUMENTS 5,111,507 A * 5/1992 Nakaji ..... G10K 11/17823 381/71.9
10,360,896 B2 7/2019 Shinno et al.
10,400,691 B2 * 9/2019 Serrano ..... F02D 13/06
2013/0156213 A1 * 6/2013 Pan ..... G10K 11/17857 381/71.4
2015/0010164 A1 1/2015 Christoph
2016/0029124 A1 * 1/2016 Paranjpe ..... G10L 21/0232 381/71.14
2016/0102620 A1 * 4/2016 Ervin ..... F02D 41/0087 123/345
2017/0178617 A1 6/2017 Christoph et al.
(Continued)

FOREIGN PATENT DOCUMENTS

DE 102016219981 A1 4/2018
DE 102018201595 A1 10/2018

OTHER PUBLICATIONS

Examination Report for German Patent Application No. 10 2020 124 232.8; Application Filing Date Sep. 17, 2020; dated Jun. 22, 2021 (12 pages).

*Primary Examiner* — Vivian C Chin
*Assistant Examiner* — Friedrich Fahnert
(74) *Attorney, Agent, or Firm* — Cantor Colburn LLP

(57) ABSTRACT

A method for noise cancellation includes monitoring a system for a current operating point, monitoring the system for a predetermined disturbance, and in response to the predetermined disturbance, determining the disturbance to be in one of a transient or steady state response period. A set of data is selected corresponding to the current operating point of the system, the disturbance, and the response period from a database containing predetermined noise cancellation waveform data. A noise cancelling waveform is output to audio transducers based upon the selected set of data.

20 Claims, 6 Drawing Sheets

(56) References Cited

U.S. PATENT DOCUMENTS

| | | | | |
|---|---|---|---|---|
| 2017/0301336 | A1 | 10/2017 | Kumar et al. | |
| 2018/0286378 | A1* | 10/2018 | Shinno | G06T 7/593 |
| 2019/0055894 | A1 | 2/2019 | Serrano et al. | |
| 2020/0357377 | A1* | 11/2020 | Bastyr | G10K 11/17854 |

* cited by examiner

AUTOMOTIVE NOISE MITIGATION

INTRODUCTION

This disclosure is related to active noise cancellation within a passenger vehicle.

Vehicle operators and occupants are accustomed to various sounds within the vehicle cabin that are characteristic of various automotive systems and vehicle operation. Such sounds include, for example, engine operation sounds generated by air intake and exhaust systems. These sounds are normal, familiar, and expected by the vehicle operators and occupants. Deviations from expected sounds may occur, for example, during various transient or temporal events. While such events may be associated with intended vehicle operation, the sound deviations may be objectionable to the operators or occupants. Accordingly, it is desirable to mitigate such sound deviations.

SUMMARY

In one exemplary embodiment a noise cancellation system includes an automotive system having a current operating point generating a noise within a cabin of an automobile. The system further includes a noise cancellation controller having a processor configured to determine a disturbance to the automotive system is active, select a set of data corresponding to the current operating point of the automotive system and the disturbance from a database containing predetermined noise cancellation waveform data, and output a noise cancelling waveform to audio transducers based upon the selected set of data.

In addition to one or more of the features described herein, the noise cancellation system includes the automotive system including an internal combustion engine system.

In addition to one or more of the features described herein, the noise cancellation system includes an internal combustion engine system and the disturbance includes an exhaust gas recirculation valve.

In addition to one or more of the features described herein, the noise cancellation system includes an internal combustion engine system having a dedicated cylinder exhaust gas recirculation loop with an exhaust gas recirculation valve wherein the disturbance includes the exhaust gas recirculation valve.

In addition to one or more of the features described herein, the noise cancellation system includes a disturbance to the automotive system including one of an A/C Clutch operation, a fuel injector pump pressure change, a selective cylinder deactivation, a cooling fan operation, and a hydraulic brake modulation.

In addition to one or more of the features described herein, the noise cancellation system includes the predetermined noise cancellation waveform data including fast Fourier transformation coefficients.

In addition to one or more of the features described herein, the noise cancellation system includes the automotive system including an internal combustion engine system and the disturbance includes an exhaust gas recirculation valve within a dedicated cylinder exhaust gas recirculation loop, and the current operating point includes a current engine rpm and torque pair.

In addition to one or more of the features described herein, the noise cancellation system includes the automotive system including an internal combustion engine system, the disturbance includes an exhaust gas recirculation valve within a dedicated cylinder exhaust gas recirculation loop, the current operating point includes a current engine rpm and torque pair, and the predetermined noise cancellation waveform data includes fast Fourier transformation coefficients.

In addition to one or more of the features described herein, the noise cancellation system of includes the noise cancelling waveform phase adjusted based upon an engine crank angle.

In addition to one or more of the features described herein, the noise cancellation system includes the processor further configured to determine the active disturbance is in a transient response period, wherein the database containing predetermined noise cancellation waveform data includes a transient calibration data table, and wherein the noise cancelling waveform is output for a predetermined duration.

In addition to one or more of the features described herein, the noise cancellation system includes the processor further configured to determine the active disturbance is in a steady state response period, wherein the database containing predetermined noise cancellation waveform data includes a steady state calibration data table, and wherein the noise cancelling waveform is output and the current operating point of the automotive system and corresponding set of data are continually updated while the disturbance is active.

In addition to one or more of the features described herein, the noise cancellation system includes the predetermined noise cancellation waveform data including fast Fourier transformation coefficients, wherein the database containing predetermined noise cancellation waveform data includes a database developed in an offline process from a phase shifted difference between undisturbed and disturbed curves representing respective averaged pluralities of time-domain waveform samples.

In another exemplary embodiment, a method for noise cancellation includes monitoring a system for a current operating point, monitoring the system for a predetermined disturbance, and in response to the predetermined disturbance, determining the disturbance to be in one of a transient or steady state response period, selecting a set of data corresponding to the current operating point of the system, the disturbance, and the response period from a database containing predetermined noise cancellation waveform data, and outputting a noise cancelling waveform to audio transducers based upon the selected set of data.

In addition to one or more of the features described herein, the method for noise cancellation includes the monitored system including an internal combustion engine system and the current operating point includes a current engine rpm and torque pair.

In addition to one or more of the features described herein, the noise cancellation system includes the monitored system including an internal combustion engine system, and the disturbance to the monitored system includes one of an A/C Clutch operation, a fuel injector pump pressure change, a selective cylinder deactivation, and a cooling fan operation.

In addition to one or more of the features described herein, the noise cancellation system includes the disturbance to the monitored system including one of an A/C Clutch operation, a fuel injector pump pressure change, and a selective cylinder deactivation, a cooling fan operation, and a hydraulic brake modulation.

In another exemplary embodiment, a noise cancellation system for a passenger vehicle includes a controller configured to monitor a vehicle system for an operating point, monitor the vehicle system for a known disturbance, based on the operating point and known disturbance, selecting a set of FFT coefficients from a predetermined database of FFT coefficients, processing the selected set of FFT coefficients into an analog waveform, and outputting the analog waveform to an audio transducer.

In addition to one or more of the features described herein, the noise cancellation system includes the controller further configured to determine the known disturbance is in a transient response period, wherein the predetermined database of FFT coefficients includes a transient calibration data table, and wherein the analog waveform is output for a predetermined duration.

In addition to one or more of the features described herein, the noise cancellation system includes the controller further configured to determine the disturbance is in a steady state response period, wherein the predetermined database of FFT coefficients includes a steady state calibration data table, and wherein the analog waveform is output and the operating point and selected set of FFT coefficients are continually updated while the disturbance is in the steady state response period.

In addition to one or more of the features described herein, the noise cancellation system includes the analog waveform phase adjusted.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
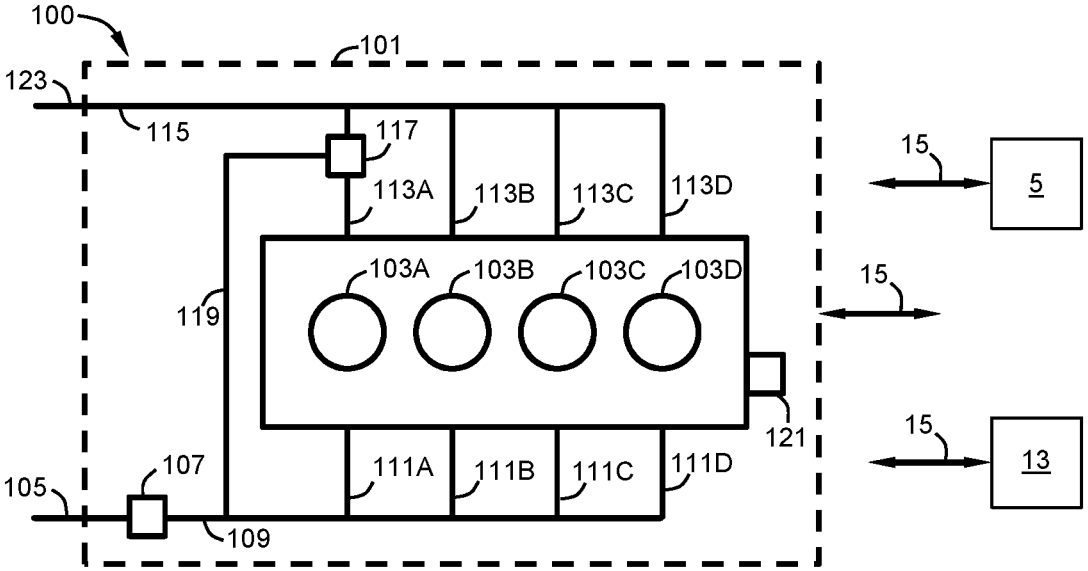
FIG. 1 illustrates an internal combustion engine system in accordance with the present disclosure.

The following description is merely exemplary in nature and is not intended to limit the present disclosure, its application or uses. It should be understood that throughout the drawings, corresponding reference numerals indicate like or corresponding parts and features.

The present disclosure describes certain exemplary embodiments in application with an internal combustion engine and passenger vehicle complement. FIG. 1 illustrates an internal combustion engine system 100 including engine 101, controller 5, and user interface 13. Engine 101 includes a plurality of cylinders 103A, 103B, 103C, 103D. Intake air passes through air intake conduit 105 and throttle valve 107 into intake manifold 109 and intake runners 111A, 111B, 111C, 111D for distribution to cylinders 103. The various intake components, including air boxes, filters and their housing for example, make up the induction system. A plurality of exhaust runners 113A, 113B, 113C, 113D receive exhaust gas from the cylinders 103. A subset of the exhaust runners 113B, 113C, 113D direct exhaust gas into exhaust manifold 115 and through exhaust conduit 123. The various exhaust components, including aftertreatment devices and mufflers for example, make up the exhaust system. At least one exhaust gas runner 113A directs exhaust gas to a valve 117 configured to controllably direct the exhaust gas from cylinder 103A to one or both of the exhaust manifold 115 and exhaust gas recirculation (EGR) conduit 119. EGR conduit may direct exhaust gas from valve 117 into intake manifold 109 downstream of throttle valve 107 as shown or into air intake conduit 105 upstream of throttle valve 107. Such an EGR configuration may be referred to as a dedicated cylinder EGR loop. Internal combustion engine system 100 further includes a crankshaft sensor 121 for sensing engine RPM and crankshaft angle.

Controller 5 signally and operatively links to various actuators and sensors in the engine system 100 via a communications link 15 to monitor and control operation of the engine 101. Crankshaft sensor 121 preferably includes an encoder from which absolute crank angle and engine rpm may be derived. Throttle valve 107 includes a throttle position sensor and may include a throttle actuator for controlling throttle position to a commanded throttle position from controller 5 or a mechanical linkage for mechanically controlling throttle position such as by throttle pedal and cruise control linkages. Controller 5 executes routines to control actuators to meet control objectives related to fuel economy, emissions, performance, and drivability, among others. Controller 5 determines from engine rpm and throttle position engine torque. Engine rpm and torque pairs define an engine operating point. A vehicle operator directs and commands operation of engine 101 through a plurality of devices 13 including, for example, an accelerator pedal, a brake pedal, a transmission range selector, and a vehicle speed cruise control. Communication link 15 may effect structured communication between various control modules and components. The communications link 15 and appropriate protocols provide for robust messaging and multi-control module interfacing among controllers and components. Communication link may include a controller area network or direct communication links. Communication link may also be effected using a wireless communications.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any controller executable instruction sets including calibrations and look-up tables. Routines are executed, such as by a central processing unit, and are operable to monitor inputs from sensing devices and other networked control modules and execute control and diagnostic routines to control operation of actuators. Routines may be executed at regular intervals during ongoing engine and vehicle operation. Alternatively, routines may be executed in response to occurrence of an event.

During normal engine operation, that is engine operation absent disturbances, the engine system 100 produces characteristic sounds perceptible by vehicle operators and occupants. These sounds are primarily produced by the induction and exhaust systems which are often tuned to provide a desired sound. However, sounds may originate from other areas of the engine system, powertrain, chassis, accessories, etc. These sounds may vary across the entirety of the engine's operating range, but they are repeatable. As such, these characteristic sounds may be mapped to the engine system's operating points as represented, for example, by engine rpm and torque. When an engine disturbance is present, the sounds produced by the engine system will vary from the characteristic sounds produced absent such disturbance. Where the disturbance is itself predictable and repeatable, then too will the sounds produced by the disturbed engine be predictable and repeatable. And, as in the case of undisturbed engine operation, the sounds produced during such predictable and repeatable disturbances also may be mapped to the engine system's operating points.

Figure 2:
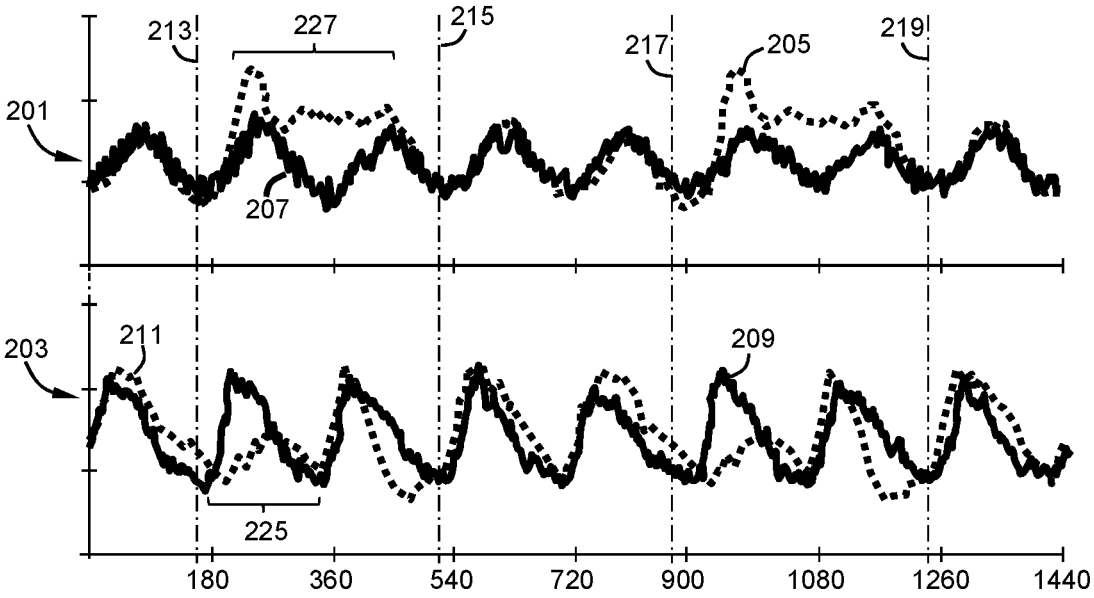
FIG. 2 illustrates engine intake and exhaust noise during disturbed and undisturbed operation of the internal combustion engine system in accordance with the present disclosure.

With reference to FIG. 2, various sound waves collected at a particular engine operating point for an exemplary four-stroke, four-cylinder internal combustion engine are illustrated. The engine operating point corresponds to engine operation at substantially 1500 rpm and a brake mean effective pressure (BMEP) of substantially 1000 kPa. The top set of sound waves 201 correspond to induction sound and the bottom set of sound waves 203 correspond to exhaust sound. Both sets of sound waves are plotted along the horizontal axis against crank angle and along respective vertical axes against dynamic pressure. Sound waves 207 and 209, shown as solid lines, correspond to undisturbed engine operation. Sound waves 205 and 211 shown as dotted lines, correspond to periodically disturbed engine operation. The respective undisturbed/disturbed sound wave pairs (207,205) and (209, 211) are plotted along a common horizontal axis with each individual sound wave having been collected at different times corresponding to respective undisturbed and disturbed engine operation. In this example, the disturbances are effective between about 150 degrees (from absolute zero crank angle degrees) and 510 degrees. In the present embodiment, the disturbance is introduced by EGR valve 117 switching cylinder 103A exhaust flow path from exhaust manifold 115 to intake manifold 109 via EGR conduit 119. As appreciated from FIG. 2, the disturbance manifests itself substantially as a missing exhaust pulse 225 and an initially increased amplitude and continuing time delayed induction pulse 227.

Figure 3:
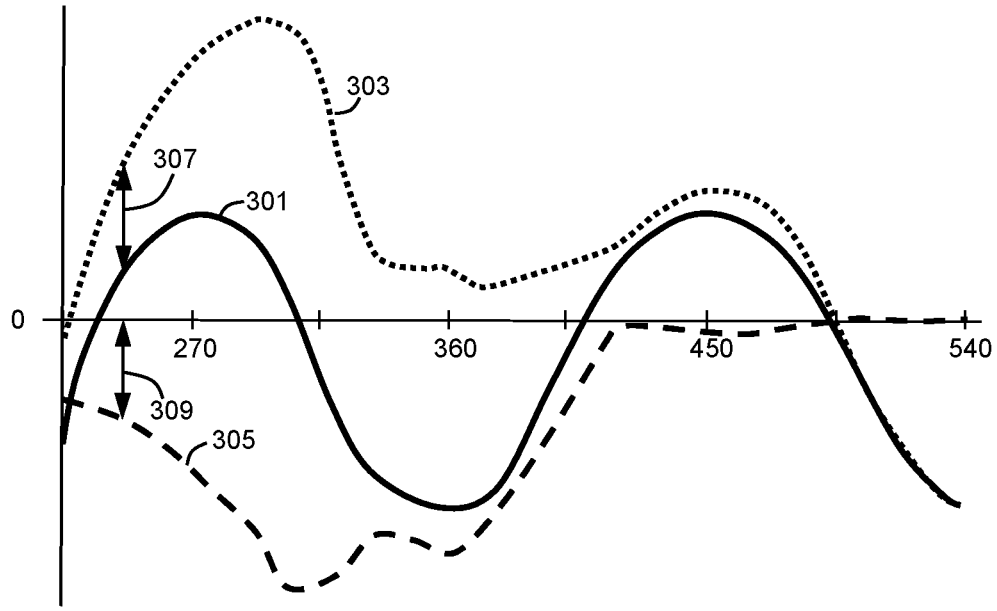
FIG. 3 illustrates various vehicle cabin sound curves in accordance with the present disclosure.

Turning to FIG. 3, and again with respect to an engine operating point corresponding to engine operation at substantially 1500 rpm and a BMEP of substantially 1000 kPa, three curves or waveforms are illustrated. Vehicle cabin sound pressure is plotted along the vertical axis relative to a zero baseline, and along the horizontal axis relative to engine crank angle. Curve 301 corresponds to undisturbed engine operation at the particular engine operating point wherein the EGR valve is directing exhaust gas from cylinder 103A into exhaust manifold 115. Curve 303 corresponds to disturbed engine operation at the particular engine operating point wherein the EGR valve is directing exhaust gas from cylinder 103A into intake manifold 109 via EGR conduit 119. Subtracting undisturbed sound curve 301 from disturbed sound curve 303 returns a sound pressure difference 307. Inversion of this difference 309 returns noise cancellation curve 305 which if summed with disturbed sound curve 303 results in the undisturbed sound curve 301. The exemplary curves of FIG. 3 correspond to the present exemplary embodiment related to the dedicated EGR configuration of FIG. 1 considering the effect that EGR switching as described has upon vehicle cabin noise. In such example, the disturbance results from activation (or deactivation) of the EGR valve. Other disturbances may result in alternative disturbed sound curves analogous to the exemplary disturbed curve 303. Such disturbances may result, for example, from other actuators whose operation may result in perceptible deviations from the undisturbed sound curve 301. Such alternative disturbed sound curves may result from operation of other automotive systems and sources of disturbances including, for example, A/C Clutch operation disturbance, fuel injector pump pressure change disturbance, selective cylinder deactivation disturbance, cooling fan operation disturbance, hydraulic brake modulation, etc.

Figure 4:
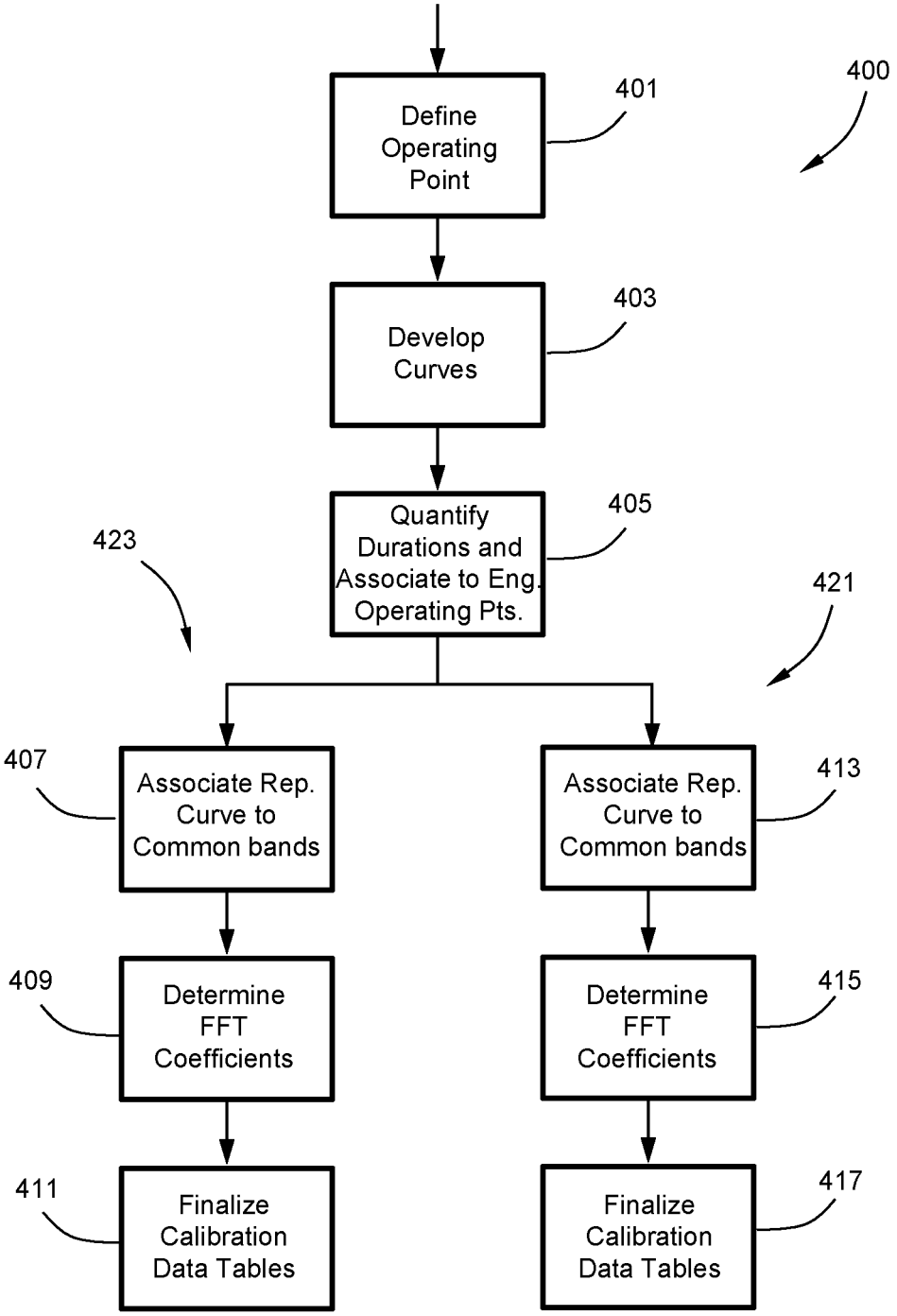
FIG. 4. illustrates offline development of calibration data tables for use in a deterministic active noise cancellation system in accordance with the present disclosure.

FIG. 4 illustrates offline development 400 of calibration data tables for use in a deterministic active noise cancellation system in accordance with the present disclosure. The offline development is performed in production or production intent vehicles as part of an active noise cancellation calibration. Vehicle system operating points for the entire operating space of the vehicle system of interest are defined with an initially relatively fine granularity relative to the variables defining the operating space. System operating space may be defined by one or more parameters of operation defining an operating point. With respect to the present embodiment related to an engine system and dedicated cylinder EGR disturbances, the engine system 100 operating space is defined two-dimensionally by rpm vs. torque (BMEP) operating points 401. Undisturbed, disturbed and cancellation curves are developed for each operating point 403. Each of the undisturbed and disturbed curves preferably represents a respective averaged plurality of time-domain waveform samples taken within the vehicle cabin and phase referenced or indexed to engine crank angle. A cancellation curve for each operating point is then synthesized in accordance with the difference between the disturbed and undisturbed curves and inverted or phase shifted 180 degrees. Alternatively, a plurality of cancellation curves for each operating point may be synthesized from each of a plurality of corresponding pairs of undisturbed and disturbed time-domain waveform samples and averaged to provide the corresponding final cancellation curve for each operating point. Any source of disturbance, though temporary, may be characterized in terms of transient and steady state effects upon the disturbed system. The transient response begins substantially at the inception of the disturbance for a duration of time or cycles that may vary with the particular operating point of the system and which may be determined objectively or subjectively during the calibration development. In the present exemplary embodiment, the transient response begins when the EGR valve directs the exhaust gases from cylinder 103A through EGR conduit 119 and into the induction system. The steady state response begins at the determined end of the transient response and continues for so long as the EGR valve directs the exhaust gases from cylinder 103A through EGR conduit 119 and into the induction system. Transient durations are quantified, for example in time or cycles, and associated or correlated to the engine operating points 405. Thus, the cancellation curves developed in 403 are preferably done so over a duration of disturbance that adequately captures transient and steady state responses of the disturbance.

In accordance with a preferred embodiment, development 400 of calibration data tables preferably includes reducing data sets used for application implementation. This preferably includes developing one set of calibration data tables for transient responses 423 and one set of calibration data tables for steady state responses 421. Among the plurality of cancellation curves may exist certain bands or ranges within the rpm vs. torque matrix defining the operating space sharing common or similar characteristics within the range of transient durations. Thus, a representative transient cancellation curve may be associated or indexed to all such operating points within such bands 407. Such a transient cancellation curve may be defined, for example, as a simple average among all individually determined cancellation curves for each respective operating point within the range. More involved techniques may include statistical and regression methods in defining the transient cancellation curves. At this position in the offline development 400 of calibration data tables, each transient cancellation curve undergoes fast Fourier transformation (FFT) to determine respective sets of FFT coefficients 409. Finally, one or more transient calibration data tables encompassing FFT coefficients and transient duration data indexed against operating point ranges is finalized 411.

Similarly, in the development 400 of calibration data tables, among the plurality of cancellation curves may exist certain bands or ranges within the rpm vs. torque matrix defining the operating space sharing common or similar characteristics for steady state operation. Thus, a representative steady state cancellation curve may be associated or indexed to all such operating points within such bands 413. Such a steady state cancellation curve may be defined in a manner as discussed above with respect to transient cancellation curves. At this position in the offline development 400 of calibration data tables, each steady state cancellation curve undergoes fast Fourier transformation (FFT) to determine respective sets of FFT coefficients 415. Finally, one or more steady state calibration data tables encompassing FFT coefficients indexed against operating point ranges is finalized 417.

Thus, it can be appreciated that the significant throughput and processing power required in known real-time active noise cancellation systems which rely on digital sampling of analog soundwaves, real-time signal processing including frequency domain conversions, algorithmic determinations of noise cancellation waveforms, time domain conversions, etc. is avoided by practicing the offline development 400 of calibration data tables. Further advantages are derived by reducing data sets thus allowing for efficient data storage and retrieval. Beneficially, the significant expense typically associated with real-time active noise cancellation hardware is largely avoided with the present active noise cancellation methods and systems practiced in accordance with the present disclosure.

Figure 5:
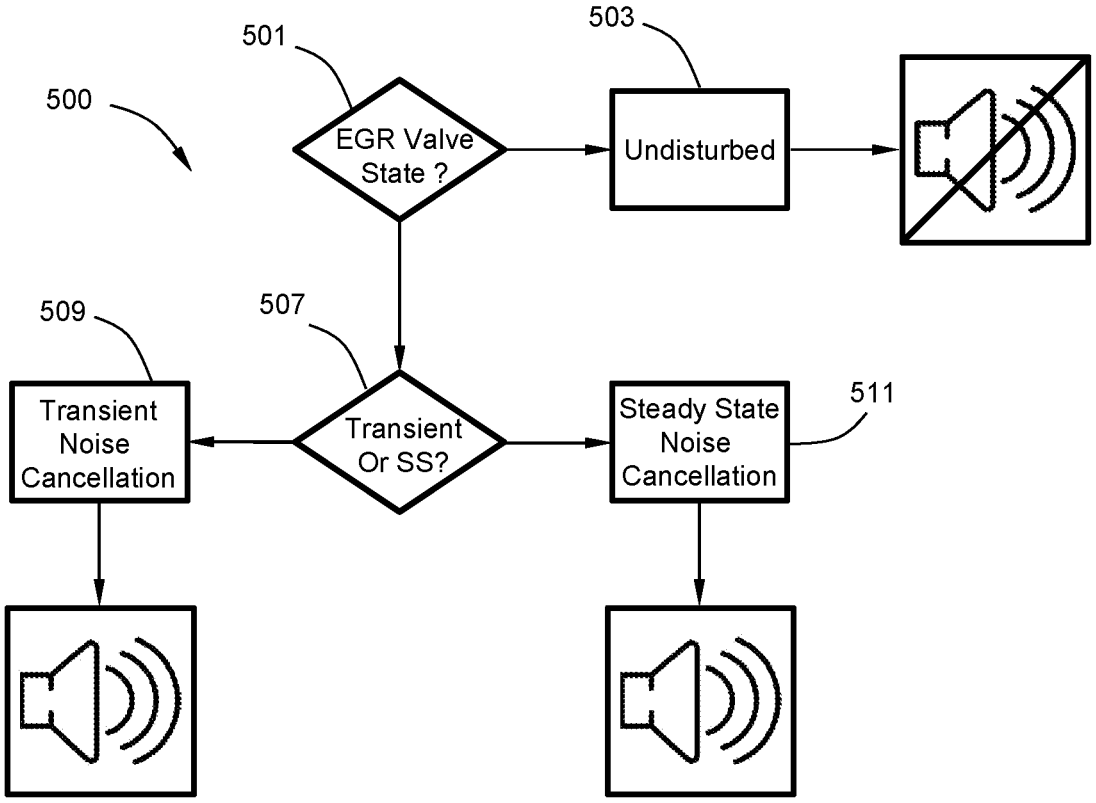
FIG. 5 illustrates active noise cancellation within a vehicle in accordance with the present disclosure.

In accordance with one embodiment of this disclosure and with reference to FIG. 5, active noise cancellation within a vehicle is implemented utilizing the calibration data tables described herein 500. Predetermined disturbance sources are monitored to determine whether a disturbance is active. In the exemplary application of a dedicated cylinder EGR loop, the EGR valve state is monitored such as by position sensing or other direct or indirect technique 501. An undisturbed system requires no further actions and active noise cancellation is not implemented 503 with respect to the monitored disturbance source (i.e. EGR valve). However, a disturbed system is determined to be in a transient or steady state response period 507 such as, for example, by time duration or system cycles. Where the disturbance is in a transient response period, a transient active noise cancellation is implemented 509. Where the disturbance is in a steady state response period, a steady state active noise cancellation is implemented 511.

Figure 6:
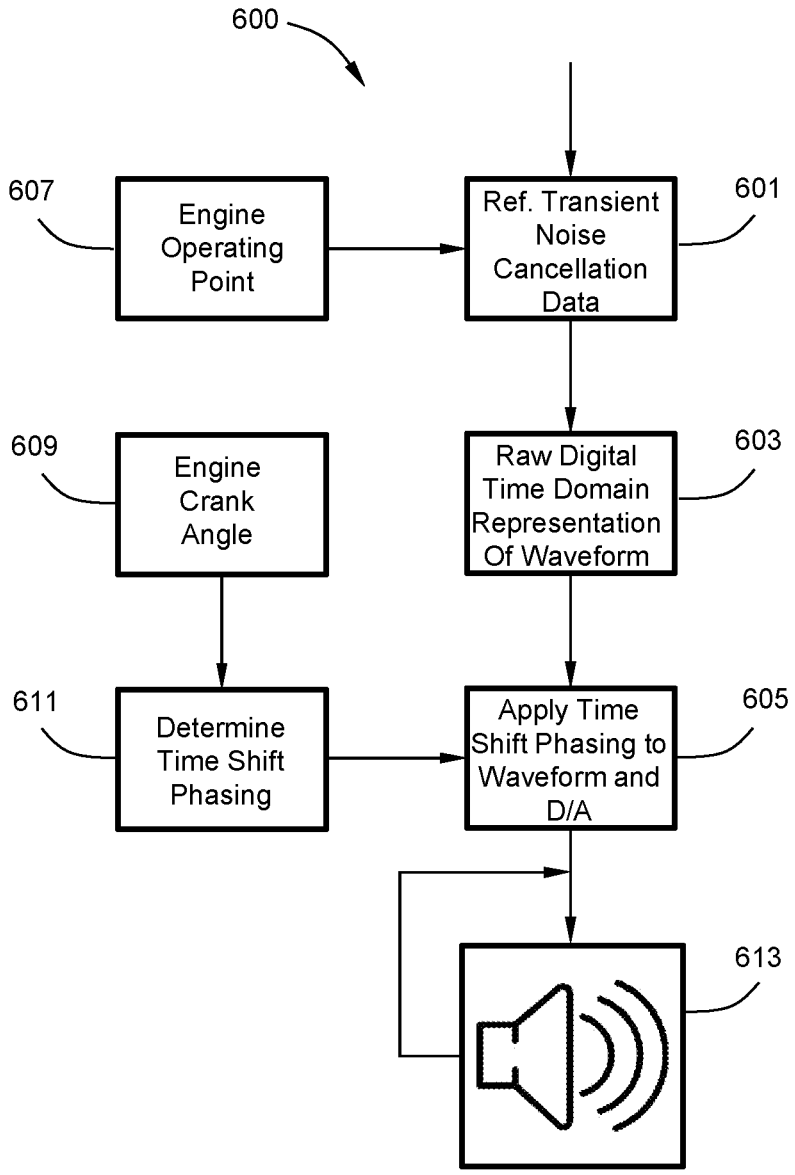
FIG. 6 illustrates transient active noise cancellation in accordance with the present disclosure.
Figure 7:
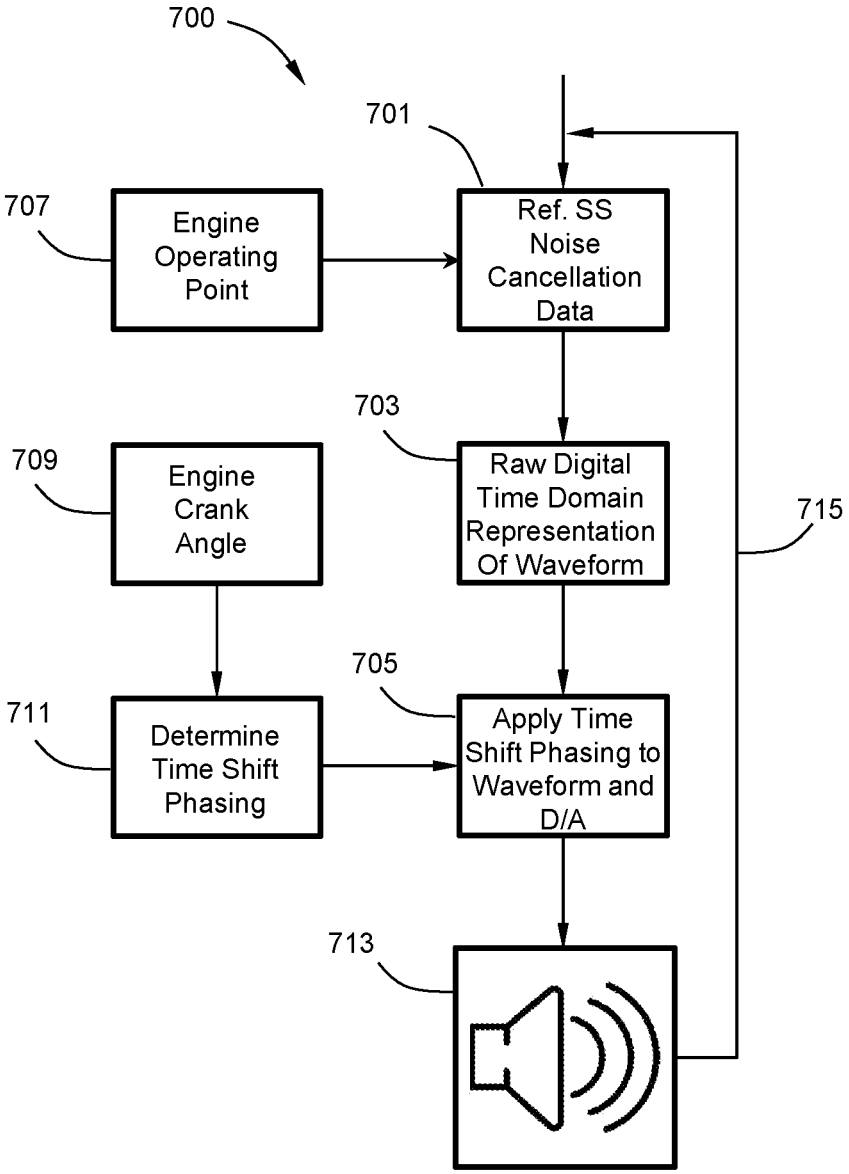
FIG. 7 illustrates steady state noise cancellation in accordance with the present disclosure.

FIGS. 6 and 7 illustrate transient active noise cancellation and steady state noise cancellation, respectively, in accordance with an exemplary embodiment. A transient active noise cancellation routine 600 begins by monitoring the engine operating point over communication link 15 and referencing a transient calibration data table at 601 based upon the engine operating point rpm and torque 607. Transient calibration data table at 601 returns a set of predetermined FFT coefficients for use in generating an analog noise cancellation waveform within the vehicle cabin. Transient noise cancellation table at 601 may also return durations, for example time or engine cycles, for the implementation of the analog noise cancellation. At 603, an active noise cancellation system processes the FFT coefficients into a raw digital time domain representation of the desired transient noise cancelling waveform. A time shift or phasing for the desired transient noise cancelling waveform is determined 611 based upon the engine crank angle 609. This time shift phasing is applied to the raw digital time domain representation of the desired transient noise cancelling waveform which undergoes a digital to analog conversion by the active noise cancelling system at 605. The active noise cancelling system outputs the phase adjusted desired transient noise cancelling waveform to audio transducers, such as those present in or complementing a vehicle entertainment system, for a duration in accordance with the desired duration of the transient noise cancellation 613. A steady state active noise cancellation routine 700 begins by monitoring the engine operating point over communication link 15 and referencing a steady state calibration data table at 701 based upon the engine operating point rpm and torque 707 available over communication link 15. Steady state calibration data table returns a set of predetermined FFT coefficients for use in generation an analog noise cancellation waveform within the vehicle cabin. At 703, an active noise cancellation system processes the FFT coefficients into a raw digital time domain representation of the desired steady state noise cancelling waveform. A time shift or phasing for the desired steady state noise cancelling waveform is determined 711 based upon the engine crank angle 709. This time shift phasing is applied to the raw digital time domain representation of the desired steady state noise cancelling waveform which undergoes a digital to analog conversion by the active noise cancelling system at 705. The active noise cancelling system outputs the phase adjusted desired steady state noise cancelling waveform to audio transducers, such as those present in or complementing a vehicle entertainment system 713. This routine continually updates for so long as the disturbance source remains active 715.

Figure 8:
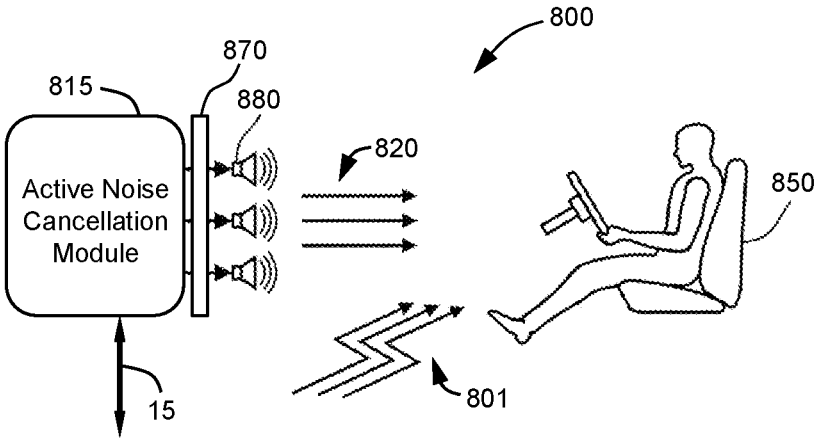
FIG. 8 illustrates an exemplary active noise cancellation system in accordance with the present disclosure.

FIG. 8 illustrates an exemplary active noise cancellation system 800 for mitigating the undesirable sound deviations in accordance with the present disclosure. Sound deviations 801 within the vehicle cabin resulting from a predetermined disturbance source can be heard by a passenger/driver 850. Active noise cancellation system 800 may include an active noise cancellation module 815 configured to generate noise cancelling waveforms 820 mimicking the steady state and transient cancellation curves to reduces the sound deviations 801 by destructively interfering with, and effectively cancelling out, the sound deviations 801. Active noise cancellation module 815 communicates via communication link 15 to other controllers sharing data, including engine control data and parameters, for example engine rpm, crank angle and torque, for use in active noise cancellation in accordance with the present disclosure. Audio transducers 880, such as those present in or complementing a vehicle entertainment system 870, project the noise cancelling waveforms 820 within the vehicle cabin of the passenger/driver 850.

Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements.

It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof

What is claimed is:

1. A noise cancellation system, comprising:

an automotive system having a current operating point generating a noise within a cabin of an automobile; and a noise cancellation controller comprising a processor configured to determine that a disturbance to the automotive system is active, select a set of data corresponding to the current operating point of the automotive system and said disturbance from a database containing predetermined noise cancellation waveform data, and output a noise cancelling waveform to audio transducers based upon said selected set of data;

wherein said processor is further configured to determine said active disturbance is in a transient response period, wherein said database containing predetermined noise cancellation waveform data comprises a transient calibration data table, and wherein said noise cancelling waveform is output for a predetermined duration.

2. The noise cancellation system of claim 1, wherein the automotive system comprises an internal combustion engine system and the disturbance comprises an exhaust gas recirculation valve.

3. The noise cancellation system of claim 2, wherein the internal combustion engine system comprises a dedicated cylinder exhaust gas recirculation loop comprising said exhaust gas recirculation valve.

4. The noise cancellation system of claim 1, wherein the disturbance to the automotive system comprises one of an air conditioning clutch operation, a fuel injector pump pressure change, a selective cylinder deactivation, a cooling fan operation, and a hydraulic brake modulation.

5. The noise cancellation system of claim 1, wherein said predetermined noise cancellation waveform data comprises fast Fourier transformation coefficients.

6. The noise cancellation system of claim 1, wherein the automotive system comprises an internal combustion engine system and the disturbance comprises an exhaust gas recirculation valve within a dedicated cylinder exhaust gas recirculation loop, and said current operating point comprises a current engine rpm and torque pair.

7. The noise cancellation system of claim 1, wherein said predetermined noise cancellation waveform data comprises fast Fourier transformation coefficients.

8. The noise cancellation system of claim 1, wherein said noise cancelling waveform is phase adjusted based upon an engine crank angle.

9. A noise cancellation system, comprising:

an automotive system having a current operating point generating a noise within a cabin of an automobile; and a noise cancellation controller comprising a processor configured to determine that a disturbance to the automotive system is active, select a set of data corresponding to the current operating point of the automotive system and said disturbance from a database containing predetermined noise cancellation waveform data, and output a noise cancelling waveform to audio transducers based upon said selected set of data;

wherein said processor is further configured to determine that said active disturbance is in a steady state response period, wherein said database containing predetermined noise cancellation waveform data comprises a steady state calibration data table, and wherein said noise cancelling waveform is output and the current operating point of the automotive system and corresponding set of data are continually updated while the disturbance is active.

10. The noise cancellation system of claim 9, wherein the automotive system comprises an internal combustion engine system and the disturbance comprises an exhaust gas recirculation valve.

11. The noise cancellation system of claim 9, wherein the internal combustion engine system comprises a dedicated cylinder exhaust gas recirculation loop comprising said exhaust gas recirculation valve.

12. The noise cancellation system of claim 9, wherein the disturbance to the automotive system comprises one of an air conditioning clutch operation, a fuel injector pump pressure change, a selective cylinder deactivation, a cooling fan operation, and a hydraulic brake modulation.

13. The noise cancellation system of claim 9, wherein said predetermined noise cancellation waveform data comprises fast Fourier transformation coefficients.

14. The noise cancellation system of claim 9, wherein the automotive system comprises an internal combustion engine system and the disturbance comprises an exhaust gas recirculation valve within a dedicated cylinder exhaust gas recirculation loop, and said current operating point comprises a current engine rpm and torque pair.

15. The noise cancellation system of claim 9, wherein said predetermined noise cancellation waveform data comprises fast Fourier transformation coefficients.

16. The noise cancellation system of claim 9, wherein said noise cancelling waveform is phase adjusted based upon an engine crank angle.

17. The noise cancellation system of claim 9, wherein said database containing predetermined noise cancellation waveform data comprises a database developed in an offline process from a phase shifted difference between undisturbed and disturbed curves representing respective averaged pluralities of time-domain waveform samples.

18. A noise cancellation system, comprising:

an automotive system having a current operating point generating a noise within a cabin of an automobile; and a noise cancellation controller comprising a processor configured to determine that a disturbance to the automotive system is active, select a set of data corresponding to the current operating point of the automotive system and said disturbance from a database containing predetermined noise cancellation waveform data, and output a noise cancelling waveform to audio transducers based upon said selected set of data;

wherein the automotive system comprises an internal combustion engine system and the disturbance comprises an exhaust gas recirculation valve within a dedicated cylinder exhaust gas recirculation loop, and said current operating point comprises a current engine rpm and torque pair;

wherein said predetermined noise cancellation waveform data comprises fast Fourier transformation coefficients; and wherein said database containing predetermined noise cancellation waveform data comprises a database developed in an offline process from a phase shifted difference between undisturbed and disturbed curves representing respective averaged pluralities of time-domain waveform samples.

19. A noise cancellation system for a passenger vehicle, comprising:

a controller configured to:

monitor a vehicle system for an operating point;

monitor said vehicle system for a known disturbance;

based on the operating point and known disturbance, select a set of fast Fourier transformation (FFT) coefficients from a predetermined database of FFT coefficients;

process the selected set of FFT coefficients into an analog waveform; and output the analog waveform to an audio transducer;

wherein said controller is further configured to determine said known disturbance is in a transient response period, wherein said predetermined database of FFT coefficients comprises a transient calibration data table, and wherein said analog waveform is output for a predetermined duration.

20. A noise cancellation system for a passenger vehicle, comprising:

a controller configured to:

monitor a vehicle system for an operating point;

monitor said vehicle system for a known disturbance;

based on the operating point and known disturbance, select a set of fast Fourier transformation (FFT) coefficients from a predetermined database of FFT coefficients;

process the selected set of FFT coefficients into an analog waveform; and output the analog waveform to an audio transducer;

wherein said controller is further configured to determine said disturbance is in a steady state response period, wherein said predetermined database of FFT coefficients comprises a steady state calibration data table, and wherein said analog waveform is output and the operating point and selected set of FFT coefficients are continually updated while the disturbance is in the steady state response period.

* * * * *